United States Patent [19]

Metz et al.

[11] Patent Number: 4,836,419

[45] Date of Patent: Jun. 6, 1989

[54] CLOSURE MECHANISM FOR LIQUID CONTAINERS

[75] Inventors: Kenneth D. Metz, Eau Claire; John W. Haggerty, Elk Mound; Steven W. Alf, Eau Claire, all of Wis.

[73] Assignee: Jennico, Inc., Eau Claire, Wis.

[21] Appl. No.: 189,172

[22] Filed: May 2, 1988

[51] Int. Cl.[4] ..... B67D 1/16

[52] U.S. Cl. ..... 222/110; 222/111; 222/182

[58] Field of Search ..... 222/109–111, 222/182, 483, 484, 487, 489, 540, 562, 564, 571, 511, 518, 525

[56] References Cited

U.S. PATENT DOCUMENTS

| | | | |
|---|---|---|---|
| 725,238 | 4/1903 | Gallagher | 222/110 |
| 789,230 | 5/1905 | Peacock | 222/111 |
| 2,221,749 | 11/1940 | Allen | 222/110 |
| 2,820,576 | 1/1958 | Livingstone | 222/111 |
| 3,078,014 | 2/1963 | Livingstone | 222/110 |
| 4,550,862 | 11/1985 | Barker et al. | 222/109 |
| 4,664,295 | 5/1987 | Iida | 222/109 |

*Primary Examiner*—Kevin P. Shaver
*Attorney, Agent, or Firm*—Merchant, Gould, Smith, Edell, Welter & Schmidt

[57] ABSTRACT

A closure mechanism is disclosed for a package for liquids where the package includes a container for housing a liquid and having opposing surfaces defining a discharge opening exposing a container interior. The closure mechanism inlcudes an intermediate member mounted on the container and covering the discharge opening. The intermediate member has a pour spout extending from a first end to a second end. A wall surrounds the pour spout and is spaced therefrom to define a liquid retaining volume. A floor is disposed within the volume adjacent the first end of the spout and having a floor opening providing liquid flow communication between the liquid retaining volume and the container interior. A cap is provided removably connected to the package and sized to cover the spout and the liquid retaining volume. A closure plate is provided for blocking flow of liquid through the floor opening when the cap is disconnected from the package.

6 Claims, 3 Drawing Sheets

CLOSURE MECHANISM FOR LIQUID CONTAINERS

BACKGROUND OF THE INVENTION

1. FIELD OF THE INVENTION

This invention pertains to a package for liquid products and more particularly to a package including a selectively operable drain for preventing undesired dripping of liquid from the package.

2. DESCRIPTION OF THE PRIOR ART

In the prior art, liquid containers with so called "dripless" pouring spouts are well known. An example of one such container is shown in U.S. Pat. No. 4,550,862 to Barker, et al. dated Nov. 5, 1988. In Barker, the liquid containing package is provided with a transition collar having an outwardly extending pouring spout. A drain hole is provided on the transition collar so that any liquid which drips down the side of the spout is drained back into the container. In the Barker patent (in columns 1 and 2 thereof), a purported disclosure of the prior art of dripless pouring spouts is set forth.

With a liquid container having the structure of the aforementioned U.S. Pat. No. 4,550,862, the drain hole of the transition collar is always open. This is not always desirable. The drain spout only needs to open after the pouring operation has been completed. At this time, the cap is normally in place on the container. It is an object of the present invention to provide a liquid containing package which drains only when the cap is inserted onto the package.

SUMMARY OF THE INVENTION

According to a preferred embodiment of the present invention, a closure mechanism is provided for a liquid package where the package includes a container for housing a liquid and having a discharge opening exposing an interior of the container. An intermediate member is mounted on the container and covers the discharge opening. The intermediate member has a pour spout. Walls spaced from the spout define a liquid retaining volume. The member includes a floor adjacent a first end of the spout and having a floor opening therethrough to provide liquid flow communication between the liquid retaining volume and the container interior. A cap is sized to be removably connected to the package and further sized to cover the spout and the liquid retaining volume when the cap is connected to the package. Blocking means are provided for blocking flow of liquid through the floor opening when the cap is disconnected from the package.

DESCRIPTION OF THE PREFERRED EMBODIMENT

Figure 6:
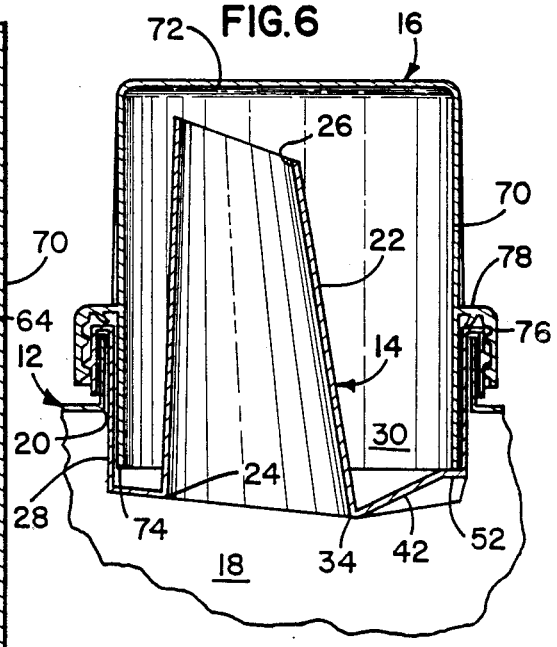
FIG. 6 is a cross-sectional view showing the closure mechanism of the present invention with a cap about to be fully inserted onto an intermediate member.
Figure 7:
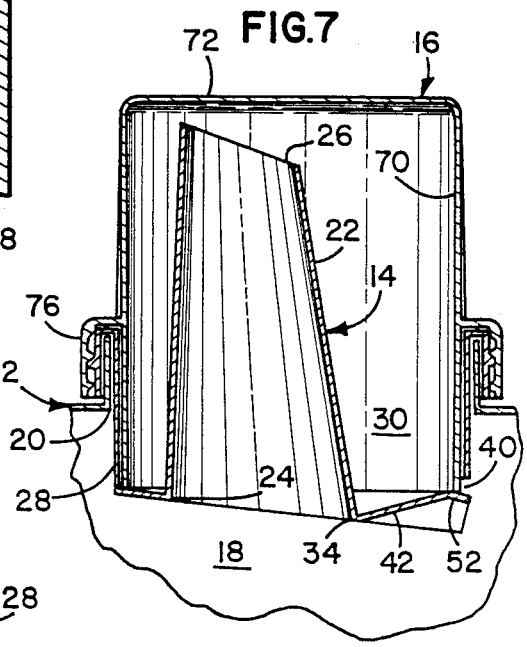
FIG. 7 is the view of FIG. 6 with the cap fully inserted onto the intermediate member.

Referring now to the several drawings wherein like numerals indicate the same elements throughout the views, a preferred embodiment of the present invention will now be described. In the preferred embodiment, the liquid containing package 10 includes a container 12 for housing a liquid and intermediate member 14 and a cap 16. The container 12 defines an interior 18 (shown in FIG. 6 and 7). Opposing surfaces of the container define a discharge opening 20 exposing the interior 18.

The intermediate member 14 includes a hollow pour spout 22 extending from a first end 24 to a second end 26. The member 14 further includes a generally cylindrical wall 28 surrounding spout 22 and spaced therefrom to define a generally annularly liquid retaining volume 30. As shown best in FIGS. 3 and 4, cylindrical wall 28 is maintained in generally parallel axially alignment with spout 22 by means of a floor 32. Floor 32 connects first end 24 of spout 22 with the opposing ends of wall 28.

Intermediate member 14 is formed of injected molded plastic. When formed, a narrow or thin hinge (line 34) is formed in the floor 32.

Figure 4:
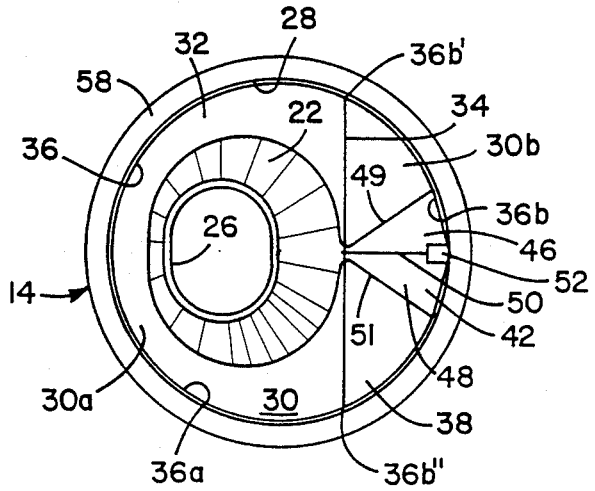
FIG. 4 is a top plan view of the intermediate member of FIG. 2.

As shown best in FIG. 4, spout 22 is not coaxial with wall 28. Instead, spout 22 is slightly spaced off-center from the center of the cylinder defined by wall 28. Therefore, liquid retaining volume 30 includes a first half **30*a* and a second half 30*b* with 30*a* being smaller than 30*b*. Hinge line 34 is disposed in that portion of floor 32 beneath volume 30*b* with hinge line 34 adjacent first end 24 of spout 22**.

As shown in the figures, intersecting surfaces of floor 32 and wall 28 define a generally circular connecting line 36. Hinge line 34 separates circular connecting line 36 into a first half **36*a* disposed beneath volume 30*a* and a second half 36*b* disposed beneath volume 30*b*. At line 36*a*, floor 32 is integrally molded with wall 28. However, at line 36*b*, floor 32 is not molded to wall 28. Instead, line 36*b* represents a cut or line of disconnection between floor 32 and wall 28. For clarity, line 36*b* extends from a first end 36*b*′ to a second end 36*b*″. Points 36*b*′ and 36*b*″ are coincident with the terminal ends of hinge line 34**.

Figure 3:
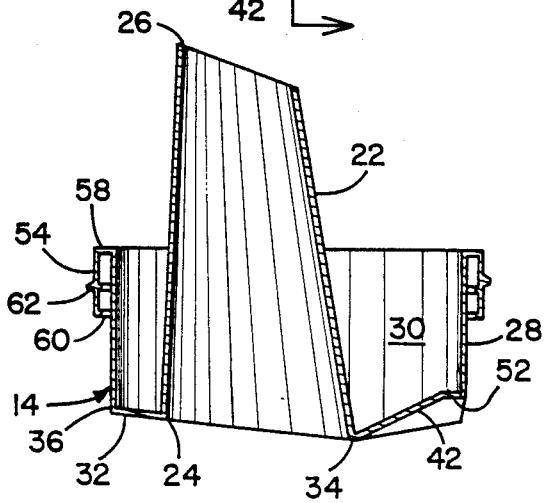
FIG. 3 is a view taken along lines 3—3 of FIG. 2.
Figure 8:
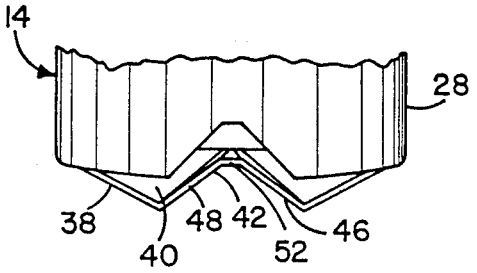
FIG. 8 is a view taken in elevation of a bottom portion of an intermediate member showing a closure plate in an open position.

That portion of floor 32 to the right of hinge line 34 (when viewed in FIG. 4) comprises a movable closure plate 38 which is hingedly connected to floor 32 at line 34. Plate 38 is pivotable about line 34 to a first position (shown in FIGS. 7 and 8) with plate 38 spaced from wall 28 to define a floor opening 40 in liquid flow communication with the interior 18 of container 12. Closure plate 38 is pivotable about the axis 34 to a second position (shown in FIGS. 3 and 6) where the closure plate 38 covers the opening 40 and, at line **36*b*, closure plate 38 abuts wall 28 in generally liquid sealing engagement. In the molding process, the plastic of intermediate member 14 is selected and molded so that closure plate 38 is biased to the second position as shown in FIG. 3** but is resilient to act against that biasing to be moved to the first position of FIG. 7.

As shown in the figures, closure plate 38 includes a generally centrally located raised portion 42. Wall 28 includes a cut out 44 to follow line 36*b* with raised portion 42. Raised portion 42 consists of two generally triangular shape planar surfaces 46 and 48 joined to each other and closure plate 38 at linear connecting lines 49, 50 and 51 (shown only in FIG. 4). At line 50, adjacent line 36*b*, raised portion 42 is provided with a flat 52.

Figure 1:
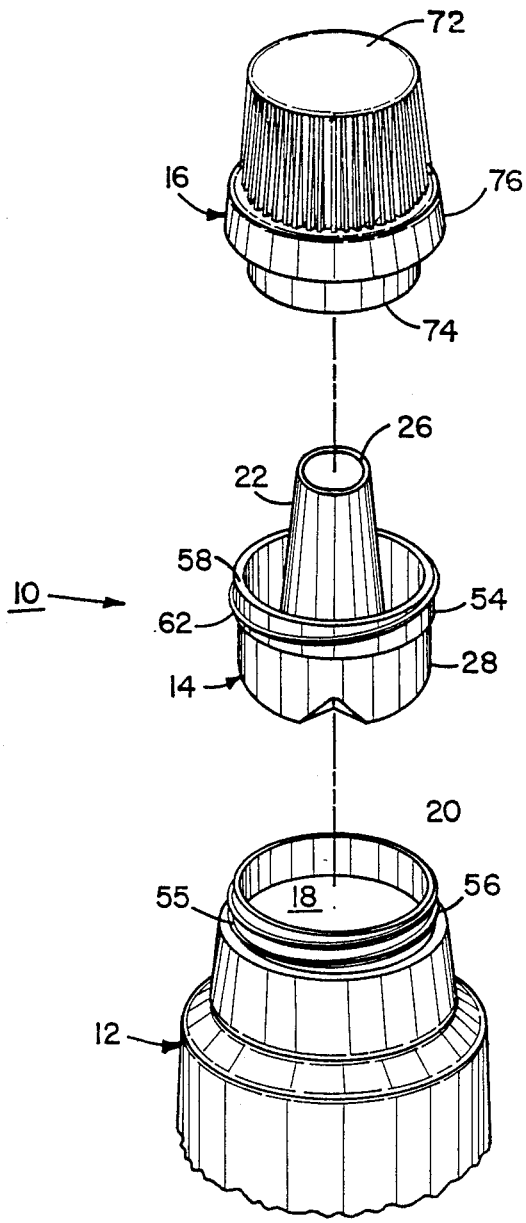
FIG. 1 is an exploded view taken in perspective showing a liquid container (partially broken away) with an intermediate member and a cap according to the present invention.
Figure 2:
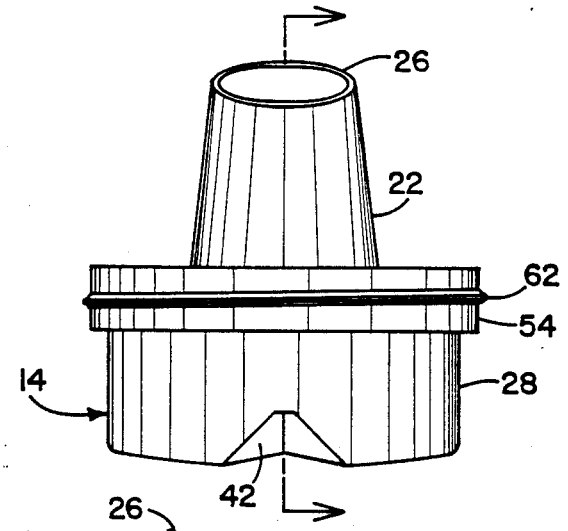
FIG. 2 is a view taken in elevation of an intermediate member, of the preset invention.
Figure 5:
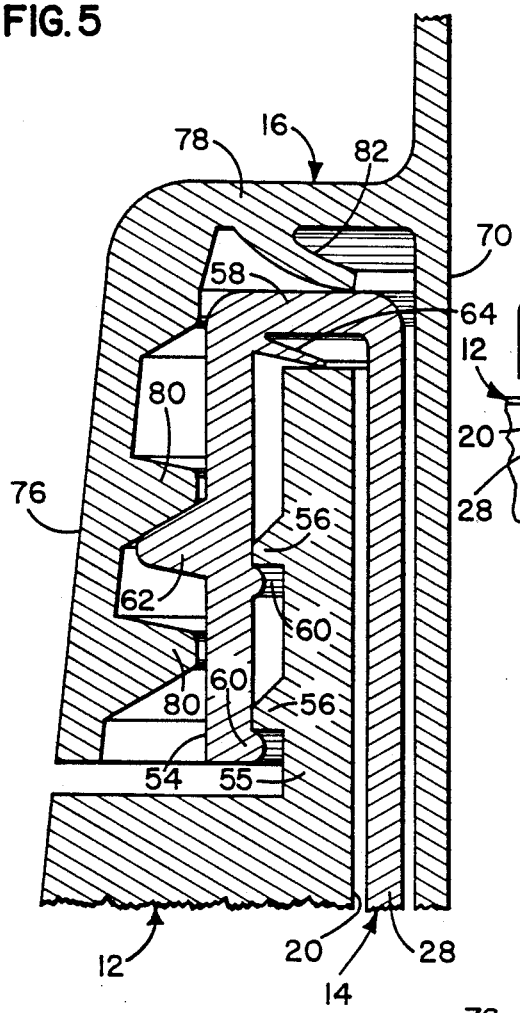
FIG. 5 is an enlarged cross-sectional view taken in elevation of connections between a cap, intermediate member and liquid container of the present invention.

Intermediate member 14 is connected to container 12 by means of a threaded collar 54. As shown best in FIGS. 1 and 5, container 12 includes a cylindrical wall 55 which defines discharge opening 20. Wall 55 is provided with external threads 56. An alternative to threaded connections is to provide wall 55 and collar 54 with opposing annular rings. The opposing rings would interlock in a snap fit when the intermediate member is forced onto the container.

Intermediate member 14 includes collar 54 surrounding wall 28 and spaced therefrom by an annular flange 58. Collar 54 includes internal threads 60 and external threads 62. Internal threads 60 are disposed to threadedly engage external threads 56 so that intermediate member 14 may be threaded onto wall 54. A seal 64 extending from annular flange 58 abuts a terminal end of wall 54 in sealing engagement (shown in FIG. 5) when intermediate member 14 is threaded onto container 12. When so connected, the member 14 covers opening 20 with spout 22 in communication with the interior 18.

Cap 16 includes a generally cylindrical wall 70 sized to surround spout 22 and be received within volume 30. A first end of cap 70 is closed by a lid 72 with a second end of wall 70 terminating at a free end 74. Between cap 72 and free end 74, an annular collar 76 spaced from wall 70 by an annular flange 78. Collar 76 is provided with internal threads 80 which are disposed to threadedly engage external threads 62 so that cap 16 may be threadedly received on intermediate member 14. A seal 82 extends from annular flange 78 toward annular flange 58 (shown in FIG. 5) to provide liquid sealing engagement between cap 16 and intermediate member 14 when the cap 16 is threadedly received onto intermediate member 14.

Wall 70 is dimensioned such that as cap 16 is threaded onto intermediate member 14, free end 74 opposes flat 52. As the cap 16 is threaded onto intermediate member 14, free end 74 is urged downwardly (when viewed in FIGS. 6 and 7) such that free end 74 abuts flat 52 and forces it downwardly against the natural biasing of the plastic. Accordingly, closure plate 38 is urged by free end 74 to pivot about hinge axis 34 and expose floor opening 40. Accordingly, any liquid which may be retained within volume 30 will flow from volume 30 into container interior 18. As the process is reversed (i.e. the cap 16 is unthreaded and removed from intermediate member 14), free end 74 moves upwardly (when viewed in the views of FIGS. 6 and 7) and the natural biasing of the plastic urges closure plate 38 upwardly such that plate 38 is in sealing engagement with wall 28 to close floor opening 40. Therefore, floor opening 40 is only open when cap 16 is fully inserted onto the intermediate member 14.

From the foregoing detailed description of the present invention, it is has been shown how the objects of the invention have been attained in a preferred manner. However, modifications and equivalents of the disclosed concepts such as readily occur to those skilled in the art are intended to be included within the scope of this invention. Thus, the scope of the invention is intended to be limited only by the scope of the claims as are, or may hereafter be, appended hereto.

I claim:

1. A closure means for a package for liquids wherein said package includes a container for housing a liquid and having opposing surfaces defining a discharge opening exposing a container interior, said closure means comprising:

an intermediate member mounted on said container and covering said discharge opening, said member having a pour spout with a first end of said spout exposed to said interior, said spout extending away from said discharge opening and terminating at a second end, said intermediate member including wall means spaced from said spout with opposing surfaces of said spout and said wall means defining a liquid retaining volume within said interior member, a floor portion disposed within said volume adjacent said first end of said spout, a floor opening through said floor portion and providing liquid flow communication between said liquid retaining volume and said container interior, a cap sized to be removably connected to said package and further sized to cover said spout and said liquid retaining volume when said cap is connected to said package;

blocking means for blocking flow of liquid through said floor opening when said cap is disconnected from said package, said blocking means includes a closure plate sized to cover said floor opening and movable between a first position with said opening exposed and a second position with said opening closed, said plate biased to said second position, means for urging said plate to said first position when said cap is connected to said package.

2. A closure means according to claim 1 wherein said plate is hingedly connected to said intermediate member, said cap including a terminal end opposing said plate when said cap is connected to said package, said cap dimensioned for said terminal end to force said plate against said biasing to said first position.

3. A closure means according to claim 1 wherein said intermediate member is molded plastic with said plate molded as part of said floor and including a hinge joint with said plastic molded for said plate to be resiliently biased to said second position.

4. A package for liquids comprising:

a container for housing a liquid and having opposing surfaces defining a discharge opening exposing a container interior;

an intermediate member mounted on said container and covering said discharge opening, said member having a pour spout with a first end exposed to said interior, said spout extending away from said discharge opening and terminating at a second end, said intermediate member including wall means spaced from said spout with opposing surfaces of said spout and said wall means defining a liquid retaining volume, a floor portion disposed within said volume adjacent said first end of the said spout, a floor opening exposed through said floor portion and providing liquid flow communication between said liquid retaining volume and said container interior;

a cap sized to be removably connected to said package and further sized to cover said spout and said liquid retaining volume; and blocking means for blocking flow through said floor opening when said cap is disconnected from said package, said blocking means includes a closure plate sized to cover said floor opening and movable between a first position with said opening exposed and a second position with said opening closed, said closure plate biased to said second position with means for urging said plate to said first position when said cap is connected to said package.

5. A package according to claim 4 wherein said plate is hingedly connected to said intermediate member, said cap including a terminal end opposing said plate when said cap is connected to said package, said cap dimensioned for said terminal end to force said plate against said biasing to said first position when said cap is connected to said package.

6. A package according to claim 4 wherein said intermediate member is molded plastic with said plate molded as part of said floor and including a hinge joint with said plastic molded for said plate to be resiliently biased by said plastic to be in said second position.

* * * * *